US005647809A

United States Patent [19]

Yip

[11] Patent Number: 5,647,809

[45] Date of Patent: Jul. 15, 1997

[54] KICKABLE TOY

[76] Inventor: Philip S. Yip, 6478 Crystal Springs Dr., San Jose, Calif. 95120

[21] Appl. No.: 545,153

[22] Filed: Oct. 19, 1995

[51] Int. Cl.[6] ..... A63B 65/00

[52] U.S. Cl. ..... 473/594; 473/575; 473/595; 446/220

[58] Field of Search ..... 273/415, 58 R; 446/220, 221

[56] References Cited

U.S. PATENT DOCUMENTS

| | | | |
|---|---|---|---|
| 1,247,809 | 11/1917 | Foster | 446/220 |
| 1,707,714 | 4/1929 | Dvilnsky | 446/220 |
| 3,048,395 | 8/1962 | Hobbs | 446/220 |
| 3,591,975 | 7/1971 | Terc | 446/220 |
| 3,749,402 | 7/1973 | Adickes et al. | 273/415 |
| 4,294,447 | 10/1981 | Clark | 273/58 R |
| 4,826,179 | 5/1989 | Callaghan | 273/58 R |
| 4,986,540 | 1/1991 | Leslie | 446/221 |
| 5,035,391 | 7/1991 | Steele et al. | 446/220 |
| 5,112,061 | 5/1992 | Lamie | 273/411 |
| 5,112,062 | 5/1992 | Pratt | 273/415 |
| 5,310,194 | 5/1994 | Scheel | 273/415 |

*Primary Examiner*—Mark S. Graham

[57] ABSTRACT

A kickable toy having a base member and a means for increasing air resistance is provided. The base member has a flexible membrane defining a boundary confining a deformable material. The means for increasing air resistance is mounted on the base member for increasing air resistance of the kickable toy to decrease the speed of free fall of the toy in air.

1 Claim, 3 Drawing Sheets

KICKABLE TOY

FIELD OF THE INVENTION

This invention relates to a toy that can be played by kicking. More particularly, the present invention relates to a toy that can be repeatedly kicked with a foot in an up and down manner.

BACKGROUND OF THE INVENTION

From time immemorial, toys have brought joy to people, especially children. A type of toy that is enjoyed by active children, as well as by many adults, is toys that are played by kicking. Such toys not only bring entertainment to the players, they also provide exercise. Well known examples are soccer and beach balls. However, recently, a toy that has been enjoying great popularity, especially among teenagers, is a kickable toy call "MAGIC HACKY SACK." This is a somewhat spherical toy about the size of a peach. It has a tough, pliable shell enclosing a relatively soft interior. This toy can be played, for example, in a game involving a person repeatedly kicking the toy in an up and down fashion without allowing the toy to fall to the ground.

Although the MAGIC HACKY SACK can be enjoyed by energetic teenagers with quick reflexes, younger children with less developed coordination and muscle-controlling ability may find the toy bouncing away too far and too fast after kicking. Therefore, such children players may have to repeatedly run after and retrieve the toy in a game. This can be frustrating to the players and may cause them to lose interest in the game. What is needed a kickable toy that can provide enjoyment and will not bounce with a fast speed or to a far distance (relative to balls that are played by kicking and MAGIC HACKY SACKs).

SUMMARY OF THE INVENTION

The present invention provides a kickable toy having a base member that has a flexible membrane defining a boundary confining a deformable material. The kickable toy further has a means mounted on the base member for increasing air resistance of the kickable toy to decrease the speed of free fall of the toy in air. The present invention further provides a method of making a kickable toy. The method includes enclosing a deformable material in a flexible membrane to form a base member and connecting a means on the base member for increasing air resistance of the kickable toy to decrease the speed of free fall of the toy in air.

In the present invention, due to the air-resistance-increasing means, the kickable toy, when kicked, will travel a less distance and will take longer to fall to the ground than if this means is absent. This will allow even less agile people to enjoy a kicking game. Further, because of the deformability of the base member, even if the base member is not kicked squarely in the middle, the base member will deform to allow a more effective energy transfer to the base member, thereby resulting in a more satisfying sound and feel of impact. In some embodiments, for example, the air-resistance-increasing means and the flexible membrane are made of the same material (e.g., the same polymeric material). This renders this invention uniquely suitable for manufacture with a mass-production operation and automatic control.

BRIEF DESCRIPTION OF THE DRAWING

The preferred embodiments of the present invention are shown in the following drawings, wherein like reference numerals represent like corresponding parts in the several views.

DETAILED DESCRIPTION OF THE PREFERRED EMBODIMENTS

Figure 1:
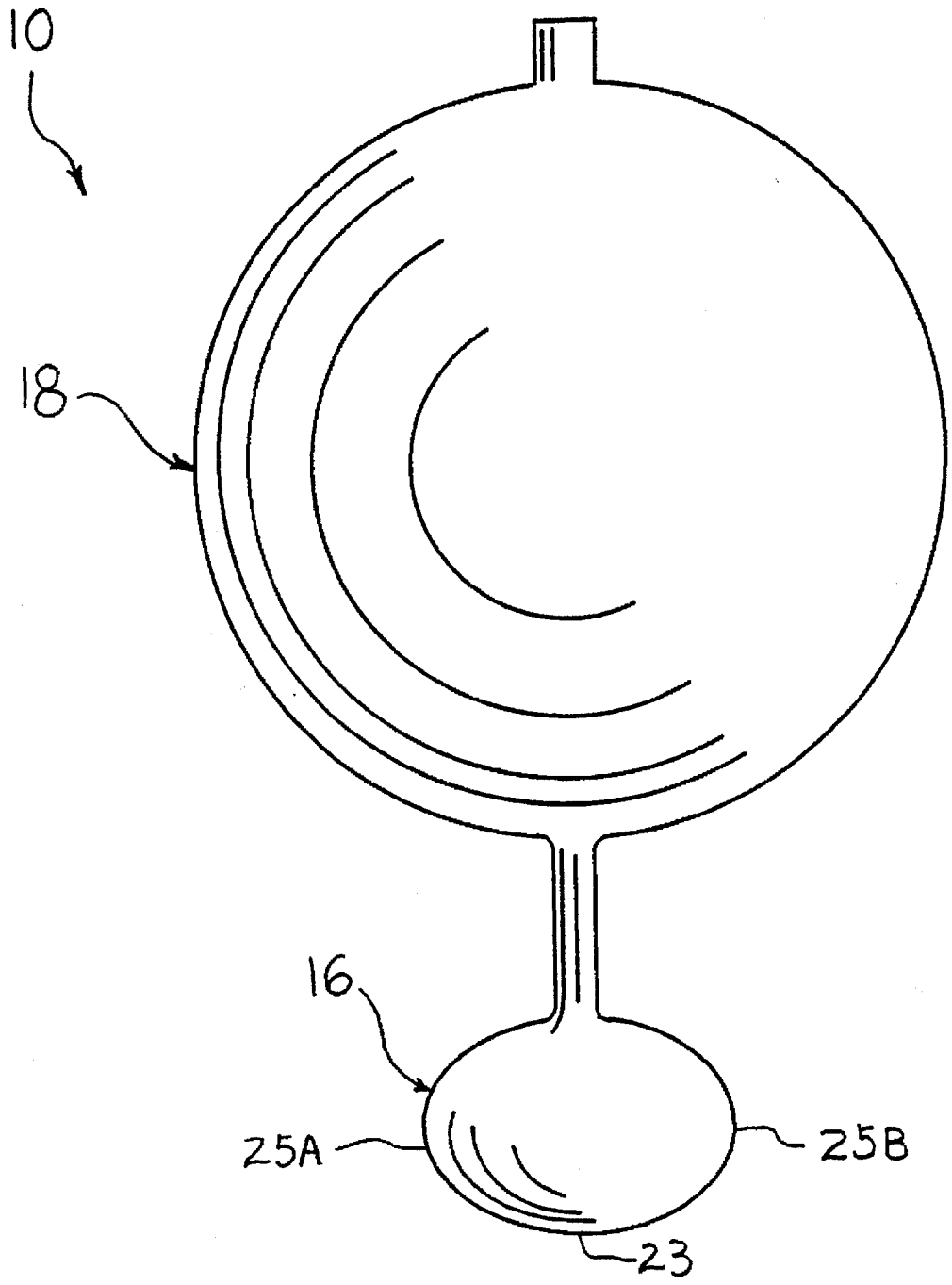
FIG. 1 is an isometric view of a preferred embodiment of a kickable toy of the present invention.

The present invention provides a toy suitable to be played by kicking. FIG. 1 shows an illustrative embodiment of such a toy. Referring to FIG. 1, the toy 10 has a base member 16 on which is connected or mounted a means 18 for increasing air resistance (or air-resistance-increasing means) as the toy free falls in the air.

Figure 2:
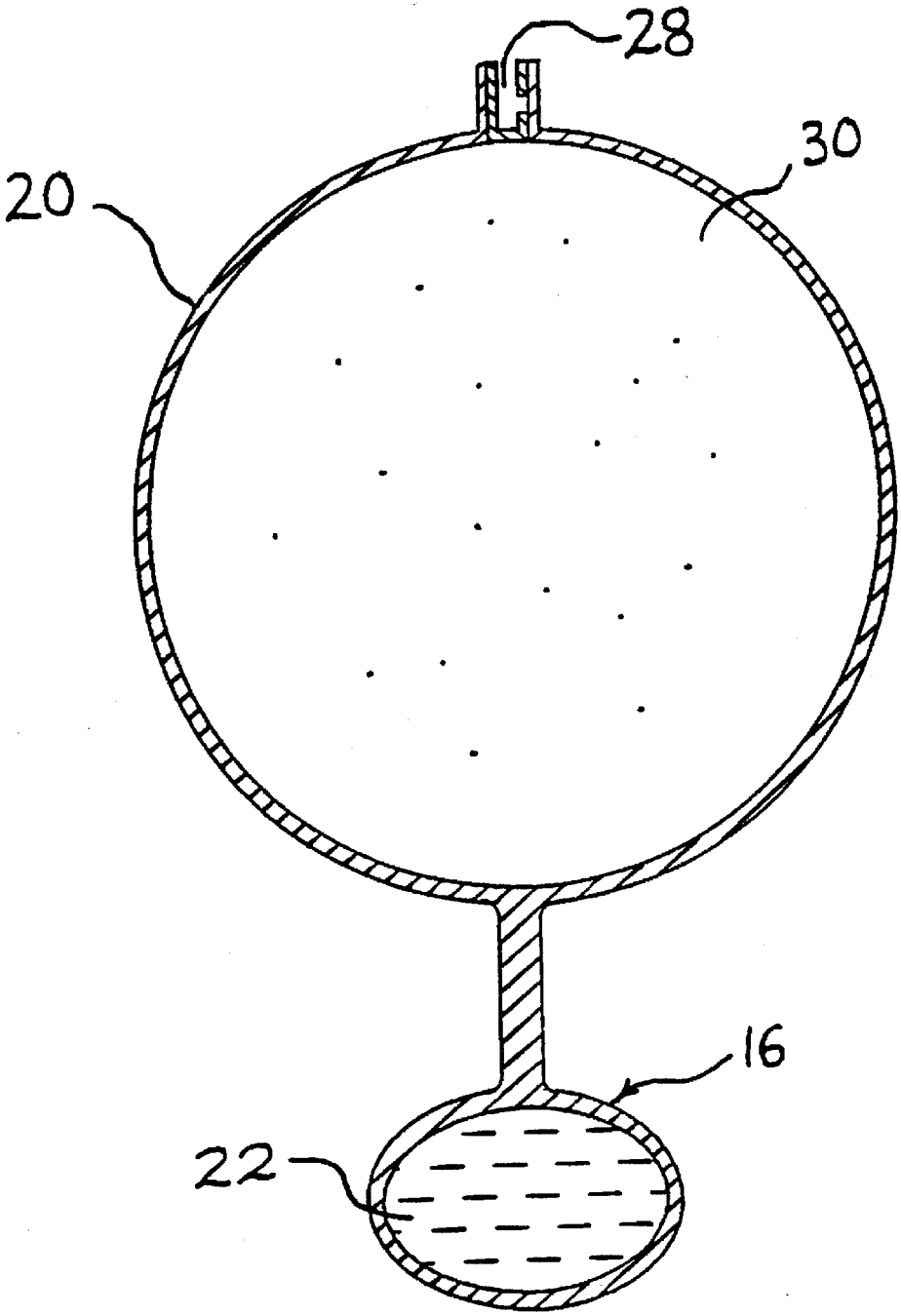
FIG. 2 is a cross-sectional view of the preferred embodiment of FIG. 1.

Referring to FIG. 1 and FIG. 2, the base member 16 has a flexible membrane 20, which is polymeric. The base member 16 contains a deformable substance 22 and is made so that when it is kicked by a foot (e.g., as in impacting upon the top surface of the foot between the toe-nails and the ankle) of a person), the base member will be deformed slightly to conform to the surface of the foot so that a large fraction of the surface of base member contacts the foot. Thus, the kicking force is efficiently transferred to the center of gravity of the base member. In this way, even if the person is less skillful and kicks the base member off center, the base member can still receive much of the kicking force to produce a satisfactory impacting sound and sensation, as well as can sail through the air as a result of the impact. Preferably, the base member 16 has a lower surface 23 that is flatter than the side surfaces 25A, 25B so that it can be aimed at and kicked in an easier manner than otherwise by a less skillful user (or player).

To provide a satisfactory impacting sound and impact sensation when the base member 20 is kicked and yet not resulting in the toy being bounced off to too far a distance, preferably, the deformable substance is capable of transferring much of the kinetic energy of the kicking body part (e.g., foot) upon impact into nonkinetic energy, such as heat. For ease of retrieval, when the toy is kicked vertically by an average minor (e.g. a 12-yea-old boy of 100 lb), preferably the kickable toy, unlike a resilient toy such as a volley ball, soccer ball, tennis ball, and the like, does not travel a distance of more than 30 feet vertically. The toy is not resilient and does not return impact energy efficiently. For example, when a base member (e.g., of about the size of a peach) hits a stationary concrete floor vertically at about 20 miles an hour (as by throwing), the base member does not bounce more than 4 inches off the floor. In the embodiment of FIG. 1, the deformable substance 22 is petroleum jelly.

The deformable substance 22 can be a semisolid or a liquid. Preferably the deformable substance is flowable so that it does not have memory to return to its original intermolecular relationship (i.e., it is permanently deformable). As used herein, the term "flowable," when referred to the deformable substance, describes the property that a part of a body of the substance (e.g., the content of the base member 16) can be made to mingle with other parts of the body by receiving a force, such as mixing or agitation action using a stirrer. More preferably the deformable substance 22 is incompressible and is a gel or gel-like substance, for example, partially cross-linked silicone oil, petroleum jelly, and the like. As used herein, liquid and nonresilient solids are considered to be incompressible. The deformable substance is selected such that it is compatible with the flexible membrane. For example, if the flexible membrane is a woven fabric or leather sewn together, the deformable substance can be solid particles. In another example, partially cross-linked silicone oil or petroleum jelly can be the deformable substance when the flexible membrane is made of silicone rubber.

Figure 3:
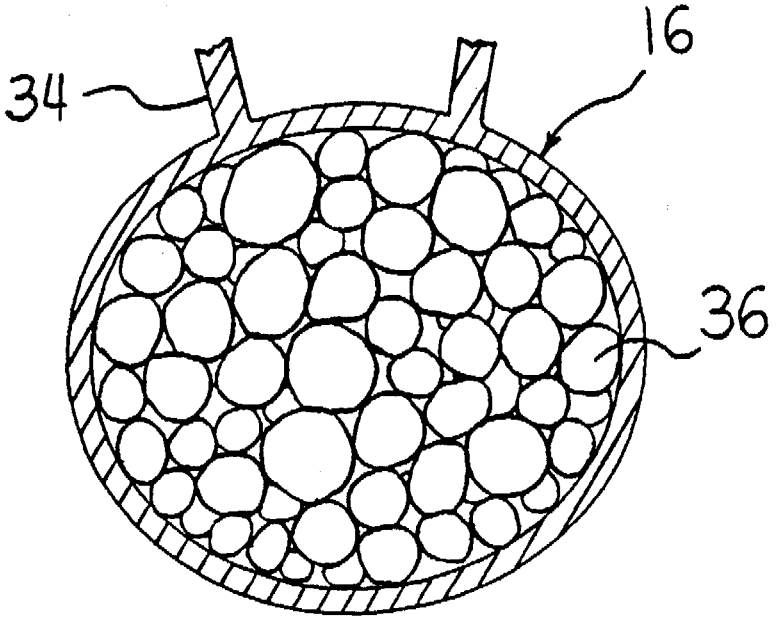
FIG. 3 is a cross-sectional view in portion of an embodiment of the present invention showing the base member in more detail.

Alternatively, the deformable substance can be composed of solid particles that nonrigidly and nonadhesively contacting other particles so that adjacent particles can slide past each other when the particles are stirred (as shown in FIG. 3). Preferably the particles have a specific gravity of less than about 1.0 (i.e., less than about 1.0 g/cc in density) so that the kickable toy can float in water. More preferably, the specific gravity is about 0.2 to 0.8. If the air-resistance-increasing means is less dense than water, the deformable material for placement inside the base member can be denser than water as long as the toy as a whole can float. Examples of particles that can be used include agricultural seeds such as grains and beans (e.g., rice, mung beans, soy beans), glass beads, plastic beads (e.g., styrofoam beads, polystyrene beads, polyethylene beads, and the like), lumber yard waste (e.g., wood chips, saw dust), and the like. The plastic beads can be made with a hollow interior to control the density, i.e., specific gravity. Standard methods for making styrofoam beads, glass beads, and hollow plastic beads are known in the art and can be used. FIG. 3 shows an alternate embodiment with links 34 linking the air-resistance increasing means 18 to a base member 16 containing beads 36.

The flexible membrane 20 can be made of nonstretchable, nonresilient materials such as leather, woven fabrics, and polymers. In an embodiment, the base membrane is a polymeric material. The polymeric substance that composes the flexible membrane 20 of the base member 16 in FIG. 1 is silicone rubber. Alternatively, other resiliently stretchable substances such as butyl rubber, latex rubber, and the like, can be used. Because of the presence of the nonresilient, nonmemory (without memory), deformable substance in the base member, even if the flexible membrane is resilient, the base member 16 as a whole is not and therefore does not tend to bounce far when kicked. Generally, the toy departs from the foot at a velocity not substantially faster (i.e. not more than about 30% faster than the foot's velocity at impact). This limits the distance travelled by the toy.

In the embodiment of FIG. 1, the air-resistance-increasing means 18 is a gas-filled balloon that is integrally connected to the base member 16, preferably by means of a link 24 which has a generally elongated shape and is thinner (i.e., smaller in the dimension perpendicular to the line connecting the centers of gravity of the base member 16 and the air-resistance-increasing means) than either the base member 16 or the air-resistance-increasing means 18. The air-resistance-increasing means 18 is less dense and has a larger surface area than the base member 16. In this way, when the toy is free-falling, the weight of the base member causes it to be positioned below the air-resistance-increasing means and the link facilitates the kicking of the base member without being hindered by the bulk of the air-resistance-increasing means. As used herein, the term "air-resistance-increasing means" refers to a structure that has a large surface area (which typically has a large volume as well) and is relatively light in weight. An important reason for incorporating such air-resistance-increasing means in the kickable toy of the present invention is to allow air to encounter a large surface area as the toy travels through the air after being kicked. This will reduce the distance of travel and lengthen the time of travel, thereby making it easier for a less skilled person to play.

The balloon of FIG. 1 has a polymeric, stretchable, flexible membrane, preferable one that is the same as that of the base member such that the base member and the balloon can be formed as an integral unit. The link 24, when present (as in FIG. 1), is preferably formed from the same material as the base member. Other flexible materials similar to those described hereinabove for the base member can be used for forming the link or the balloon. The link 24 is optional. The base member 16 can be directly connected to the air-resistance-increasing means (e.g., balloon) 18 to improve the mechanical integrity of the toy. When the toy is kicked, the air-resistance-increasing means catches the wind to slow down the fall of the toy, thereby directing the more dense base member 16 to face downward.

The balloon preferably has a valve 28 for introducing a suitable gas 30 into the balloon. Various kinds of valves, for example, those found in beach balls, basket balls, or tires can be used. Alternatively, the valve can be an elongated part of the balloon that is tied into a knot to prevent the gas from escaping, or the balloon can be completely sealed to confine the gas therein. Preferably, the valve is positioned in a location distal from the base member to avoid being damaged when the base member is kicked.

The gas 30 for filling the balloon can be any commonly available gas 30 such as helium, air, carbon dioxide, nitrogen, mixtures thereof, and the like. The air resistance of the toy can be adjusted by the selection of the gas and blowing the balloon to a desired size. For example, if a very slow free-falling velocity is desired, a gas that is lighter than air, such as helium, can be used to blow the balloon up to a size such that the toy almost floats in air.

The air-resistance-increasing means has a larger surface area than that of the base member. This large surface provides additional surface for coloring (usually two or more colors) to increase the attractiveness of the kickable toy.

The present invention has been described in the foregoing specification. The preferred embodiment is for illustrative purpose only and is not to be interpreted as unduly limiting the scope of the invention. It is to be understood that modifications and alterations of the invention, especially in size and shape, will be apparent to those skilled in the art without departing from the spirit and scope of the invention. For example, the various embodiments of base members and air-resistance-increasing means can be combined in different combinations and the relative sizes of the air-resistance-increasing means, the link, and the base member can be varied to accomplish the desired rate of descend in air so that the toy can be kicked easily. The toy can also be used by hitting with other parts of a human body (e.g. hand) or a racket instead of kicking.

What is claimed is:

1. A kickable toy comprising:

a base member having a flexible membrane defining a boundary confining a deformable, semisolid material, to deform according to the surface of a foot when kicked thereby;

a means mounted on the base member for increasing air resistance of the kickable toy to decrease the speed of free fall of the toy in air, the means including a balloon inflated with a gas for increasing the air resistance of the kickable toy to decrease the speed of free fall in air and such that the kickable toy has an overall specific gravity of less than 1, the specific gravity of the means being adjustable to adjust the speed of free fall.

* * * * *